US006638079B1

(12) United States Patent
Billman et al.

(10) Patent No.: US 6,638,079 B1
(45) Date of Patent: Oct. 28, 2003

(54) CUSTOMIZABLE ELECTRICAL CONNECTOR

(75) Inventors: Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/232,134

(22) Filed: Aug. 29, 2002

Related U.S. Application Data

(63) Continuation-in-part of application No. 10/192,109, filed on Jul. 9, 2002, which is a continuation-in-part of application No. 10/152,936, filed on May 21, 2002, and a continuation-in-part of application No. 10/154,318, filed on May 22, 2002.

(51) Int. Cl.[7] ..... H01R 12/00
(52) U.S. Cl. ..... 439/76.1; 439/79
(58) Field of Search ..... 439/76.1, 79, 65, 439/101, 108, 608, 701, 80, 67, 712, 680, 638, 650–654

(56) References Cited

U.S. PATENT DOCUMENTS 5,066,236 A * 11/1991 Broeksteeg ..... 439/79
5,795,191 A * 8/1998 Preputnick et al. ..... 439/608
5,924,899 A * 7/1999 Paagman ..... 439/701
5,980,321 A * 11/1999 Cohen et al. ..... 439/608
5,993,259 A * 11/1999 Stokoe et al. ..... 439/608
6,083,047 A * 7/2000 Paagman ..... 439/608
6,116,926 A * 9/2000 Ortega et al. ..... 439/108
6,123,554 A * 9/2000 Ortega et al. ..... 439/79
6,123,586 A * 9/2000 MacDougall ..... 439/701
6,132,255 A * 10/2000 Verhoeven ..... 439/608
6,146,202 A * 11/2000 Ramey et al. ..... 439/608
6,152,747 A * 11/2000 McNamara ..... 439/108
6,168,469 B1 * 1/2001 Lu ..... 439/608
6,171,115 B1 * 1/2001 Mickievicz et al. ..... 439/76.1
6,174,202 B1 * 1/2001 Mitra ..... 439/608
6,183,301 B1 * 2/2001 Paagman ..... 439/608
6,196,853 B1 * 3/2001 Harting et al. ..... 439/79
6,231,391 B1 * 5/2001 Ramey et al. ..... 439/608
6,238,245 B1 * 5/2001 Stokoe et al. ..... 439/608
6,267,604 B1 * 7/2001 Mickievicz et al. ..... 439/79
6,293,827 B1 * 9/2001 Stokoe ..... 439/608
6,299,483 B1 * 10/2001 Cohen et al. ..... 439/608
6,299,484 B2 * 10/2001 Van Woensel ..... 439/608
6,322,379 B1 * 11/2001 Ortega et al. ..... 439/108
6,343,955 B2 * 2/2002 Billman et al. ..... 439/608
6,347,962 B1 * 2/2002 Kline ..... 439/608
6,354,877 B1 * 3/2002 Shuey et al. ..... 439/608
6,361,366 B1 * 3/2002 Shuey et al. ..... 439/608
6,364,710 B1 * 4/2002 Billman et al. ..... 439/608
6,371,813 B2 * 4/2002 Ramey et al. ..... 439/608
6,375,508 B1 * 4/2002 Pickles et al. ..... 439/608
6,379,188 B1 * 4/2002 Cohen et al. ..... 439/608
6,386,924 B2 * 5/2002 Long ..... 439/701

(List continued on next page.)

6,390,857 B1 * 5/2002 Pickles et al. ..... 439/680
6,394,822 B1 * 5/2002 McNamara ..... 439/108
6,409,543 B1 * 6/2002 Astbury et al. ..... 439/608
6,431,914 B1 * 8/2002 Billman ..... 439/608
6,435,913 B1 * 8/2002 Billman ..... 439/608
6,435,914 B1 * 8/2002 Billman ..... 439/608

*Primary Examiner*—Ross Gushi
(74) *Attorney, Agent, or Firm*—Wei Te Chung

(57) ABSTRACT

An electrical connector includes an insulative housing (110; 310), a number of wafers (130; 350) accommodated in the insulative housing, and a number of inner printed circuit boards (120; 320). Each wafer has a wafer body (131; 3113), a number of electrical contacts (132; 330) mounted to the wafer body and a grounding bus (133; 340) mounted to the wafer body. Each inner printed circuit board has a mounting portion (124; 324) detachably inserted between two adjacent wafers to electrically contact with the signal contacts and the grounding buses and a mating portion (123; 323) adapted for engaging with a complementary electrical connector.

18 Claims, 16 Drawing Sheets

U.S. PATENT DOCUMENTS 6,461,202 B2 * 10/2002 Kline ..... 439/701
6,471,549 B1 * 10/2002 Lappohn ..... 439/608
6,478,624 B2 * 11/2002 Ramey et al. ..... 439/608
6,500,029 B2 * 12/2002 Nitta ..... 439/608
6,506,076 B2 * 1/2003 Cohen et al. ..... 439/608
6,514,103 B2 * 2/2003 Pape et al. ..... 439/608
6,517,360 B1 * 2/2003 Cohen ..... 439/65
6,520,803 B1 * 2/2003 Dunn ..... 439/608
6,530,790 B1 * 3/2003 McNamara et al. ..... 439/108
6,537,087 B2 * 3/2003 McNamara et al. ..... 439/108
6,540,522 B2 * 4/2003 Sipe ..... 439/61
6,540,558 B1 * 4/2003 Paagman ..... 439/608
6,544,045 B1 * 4/2003 Paagman ..... 439/79
6,544,046 B1 * 4/2003 Hahn et al. ..... 439/83
6,551,140 B2 * 4/2003 Billman et al. ..... 439/608
6,554,647 B1 * 4/2003 Cohen et al. ..... 439/607
6,579,124 B1 * 6/2003 Vanbesien ..... 439/608
6,592,381 B2 * 7/2003 Cohen et al. ..... 439/80

* cited by examiner

CUSTOMIZABLE ELECTRICAL CONNECTOR

CROSS-REFERENCE TO RELATED APPLICATIONS

This is a Continuation-In-Part (CIP) of U.S. patent application Ser. No. 10/192,109 filed on Jul. 9, 2002, entitled "HIGH DENSITY ELECTRICAL CONNECTOR ASSEMBLY WITH REDUCED INSERTION FORCE", which is a CIP of U.S. patent application Ser. No. 10/152,936 filed on May 21, 2002, entitled "ELECTRICAL CONNECTOR"; a CIP of U.S. patent application Ser. No. 10/154,318 filed on May 22, 2002, entitled "HIGH DENSITY ELECTRICAL CONNECTOR"; and related to U.S. patent application Ser. No. 09/746,088 filed on Dec. 21, 2000, entitled "ELECTRICAL CONNECTOR HAVING LEADING CAP FOR FACILITATING PRINTED CIRCUIT BOARD IN THE CONNECTOR INTO A MATING CONNECTOR", now issued as U.S. Pat. No. 6,390,857 on May 21, 2002; U.S. patent application Ser. No. 09/749,086 filed on Dec. 26, 2000, entitled "ELECTRICAL CONNECTOR ASSEMBLY HAVING THE SAME CIRCUIT BOARDS THEREIN", now issued as U.S. Pat. No. 6,375,508 on Apr. 23, 2002; U.S. patent application Ser. Nos. 10/150,638, 10/162,724, 10/152,540, 10/161,471 and 10/165,576, filed respectively on May 17, 2002, Jun. 4, 2002, May 20, 2002, May 30, 2002 and Jun. 21, 2002, entitled respectively "ELECTRICAL CONNECTOR HAVING PRINTED SUBSTRATES THEREIN ELECTRICALLY CONTACTING CONDUCTIVE CONTACTS THEREOF BY SOLDERLESS", "HIGH DENSITY ELECTRICAL CONNECTOR WITH LEAD-IN DEVICE", "CONTACT FOR ELECTRICAL CONNECTOR", "HIGH DENSITY ELECTRICAL CONNECTOR WITH IMPROVED GROUNDING BUS", "CONTACT FOR ELECTRICAL CONNECTOR". All of the above U.S. patent applications are assigned to the same assignee as this patent application and disclosures thereof are all incorporated herein for reference.

BACKGROUND OF THE INVENTION

1. Field of the Invention

The present invention relates to electrical connectors, and particularly to an electrical connector which is customizable.

2. Description of the Related Art

An arrangement for joining several printed circuit boards is to have one printed circuit board serve as a backplane and other printed circuit boards, called daughter boards, connected through the backplane. The backplane is usually provided with many connectors. Conducting traces in the printed circuit board connect signal pins in the connectors so that signals may be routed between the connectors. The daughter boards also contain connectors that are plugged into the connectors on the backplane. In this way, signals are routed among the daughter boards through the backplane.

Continued advances in the design of electronic devices for data processing and communications systems have placed rigorous demands on the design of electrical connectors. Specifically, electrical connectors for electrically connecting the backplanes and the daughter boards need to have higher densities and pin counts for design advances which increase integration of solid state devices and which increase the speed of data processing and communication. However, the increased density and pin counts unavoidably add the difficulties of mounting the electrical connectors to the backplanes and/or the daughter boards and of mating the electrical connector on the daughter board with the electrical connector on the backplane. Even worse, every electrical connector is often designated for only one use, that is, when the application of one electrical connector is decided, for example, to transmit signals or signal plus power, the whole electrical connector including the insulative housing and the electrical contacts etc. must be replaced by another electrical connector designated for transmitting power if another application needs to transmit just power. This is cost and undesirable for customers because the high pin count and high density electrical connector requires a relatively expensive and complicated manufacturing procedure.

U.S. Pat. No. 5,975,921 issued on Nov. 2, 1999 discloses an electrical connector devoted to solve the problems of how to mount to a printed circuit board.

U.S. Pat. No. 6,220,896 issued on Apr. 24, 2001 is directed to an electrical connector using the stripline configuration to reduce the cross talk between signal contacts thereof.

U.S. Pat. No. 6,227,882 issued on May 8, 2001 discloses an electrical connector balancing the forces between electrical contacts thereof and of an electrical connector complementary therewith.

U.S. Pat. No. 6,299,484 issued on Oct. 9, 2001 discloses an electrical connector, a shielding plate of which is mechanically supported by and electrically connected with one of a column of electrical contacts thereof.

U.S. Pat. Nos. 6,179,663 and 6,206,729 issued respectively on Jan. 30, 2001 and Mar. 27, 2001 respectively disclose an electrical interconnect system having each of a first and a second electrical connectors thereof use multiple grounding methods to reduce or prevent spurious signals from interfering with high density contacts carrying high speed transmissions.

None of the electrical connectors of the above-mentioned patents addresses the problem of providing a customizable electrical connector. Therefore, an improved electrical connector is desired.

SUMMARY OF THE INVENTION

A major object of the present invention is to provide a customizable electrical connector comprising a plurality of inner printed circuit boards which are easy to be replaced when desired.

An electrical connector in accordance with the present invention comprises an insulative housing, a plurality of wafers accommodated in the insulative housing, and a plurality of inner printed circuit boards each comprising a mating portion and a mounting portion. Each wafer comprises an insulative wafer body, a plurality of signal contacts mounted to one side of the wafer body, and a grounding bus mounted to the wafer body and each comprising a plurality of fingers extending along the one side of the wafer body and a plurality of tabs extending along the other side of the wafer body. The mounting portion of each inner printed circuit board is detachably inserted between two adjacent wafers and electrically contacts with the signal contacts and fingers of one wafer and tabs of another adjacent wafer.

Other objects, advantages and novel features of the invention will become more apparent from the following detailed description of the present embodiment when taken in conjunction with the accompanying drawings.

DETAILED DESCRIPTION OF THE INVENTION

Figure 1:
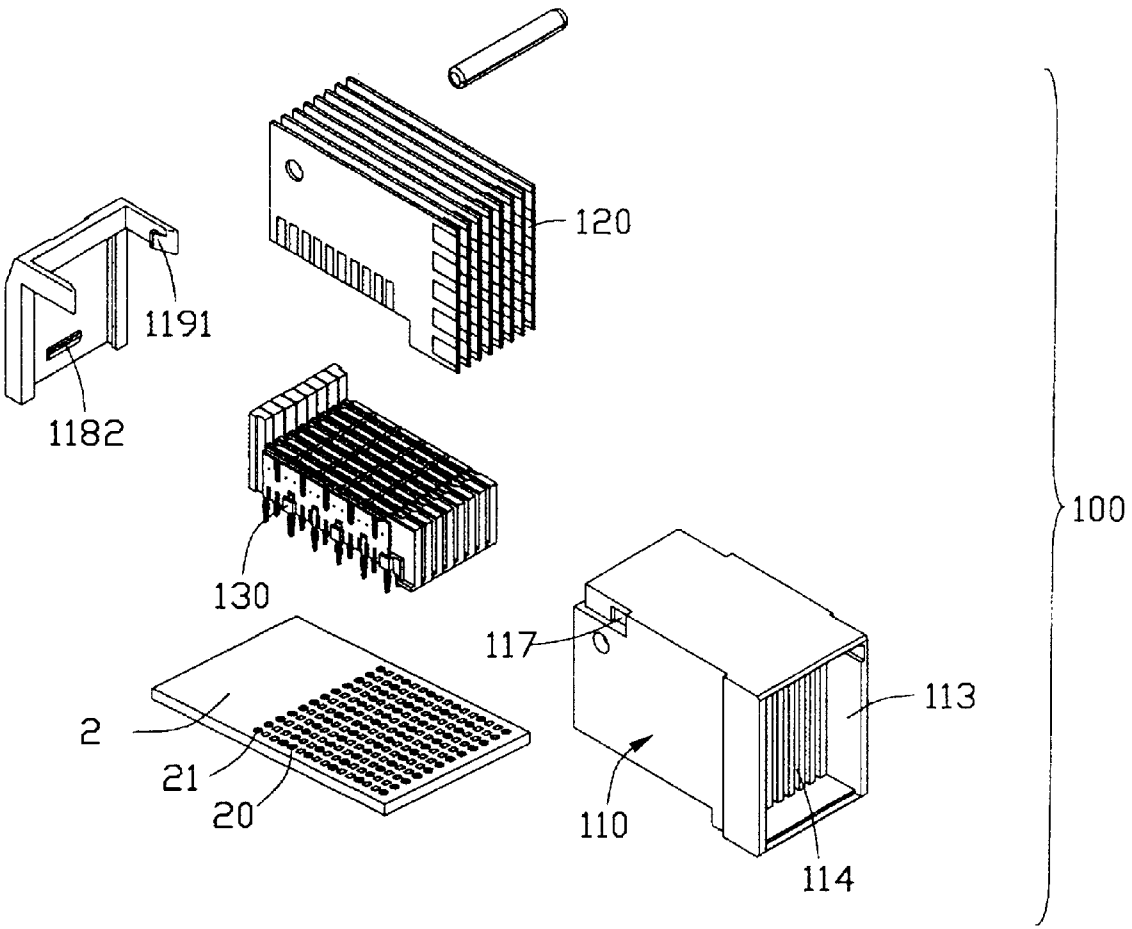
FIG. 1 is an exploded view of an electrical connector in accordance with a first embodiment of the present invention and a printed circuit board to which the electrical connector is mounted.
Figure 2:
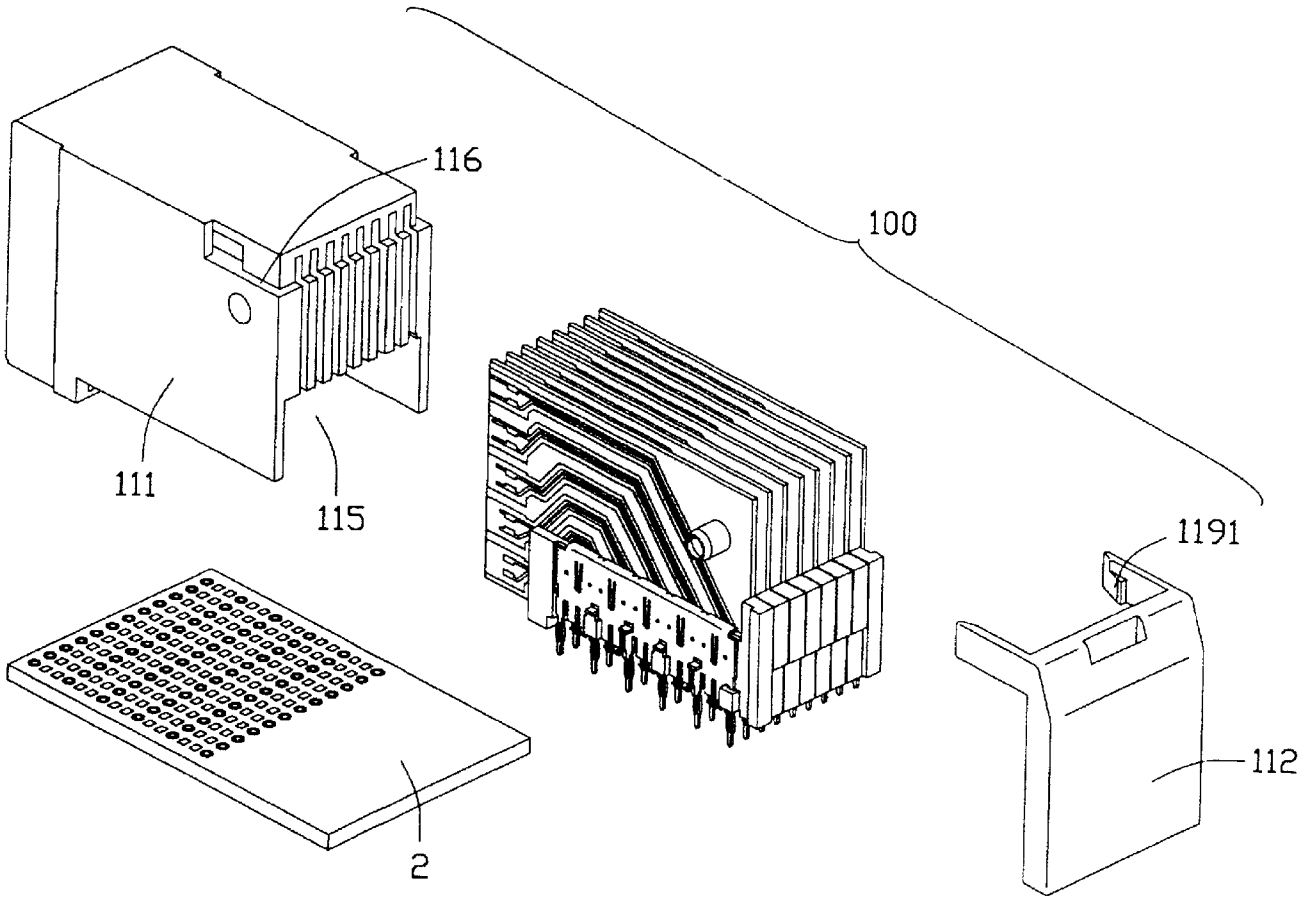
FIG. 2 is a view similar to FIG. 1 but taken from another perspective.
Figure 3:
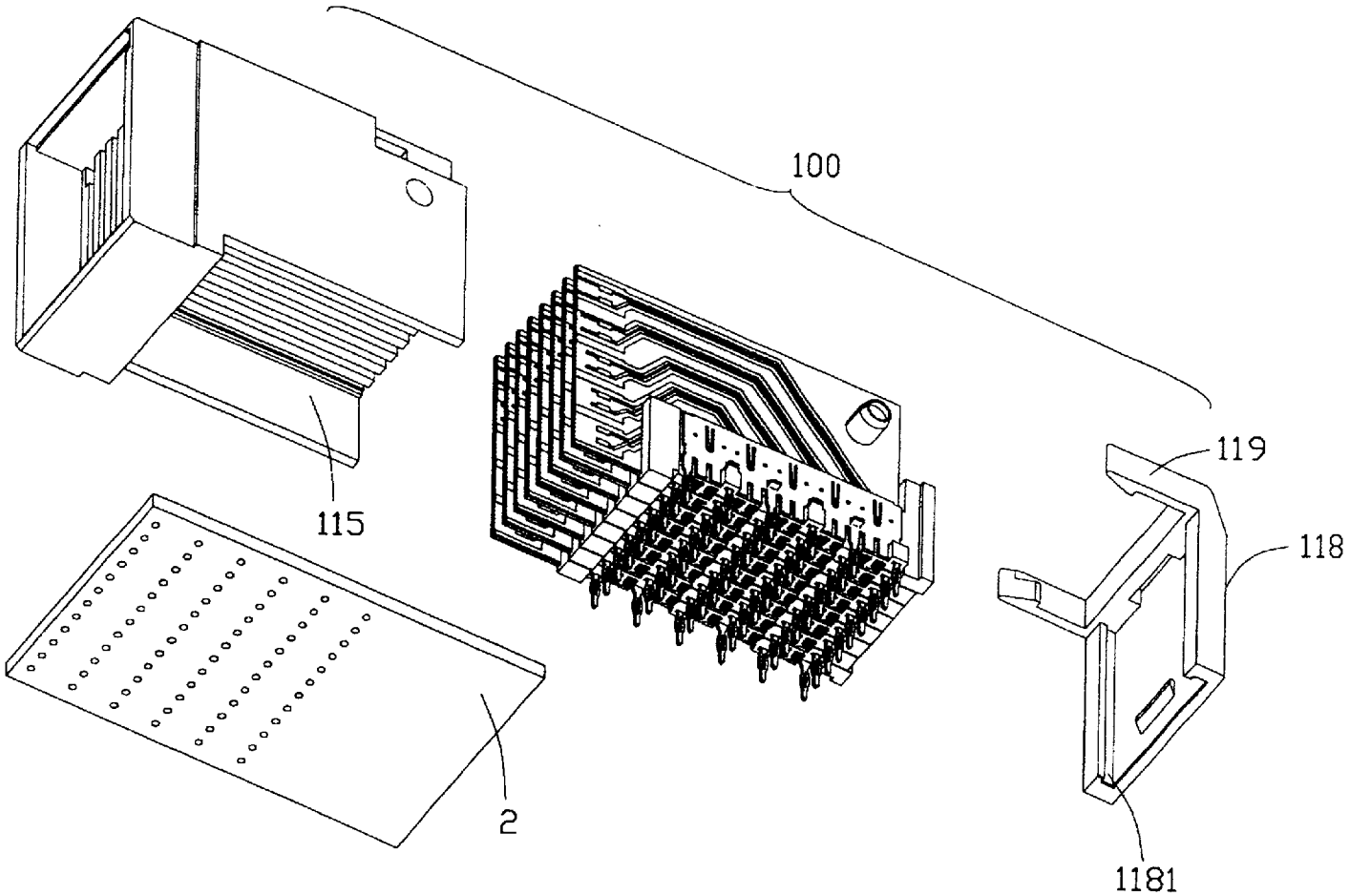
FIG. 3 is a view similar to FIG. 1 but taken from yet another perspective.
Figure 4:
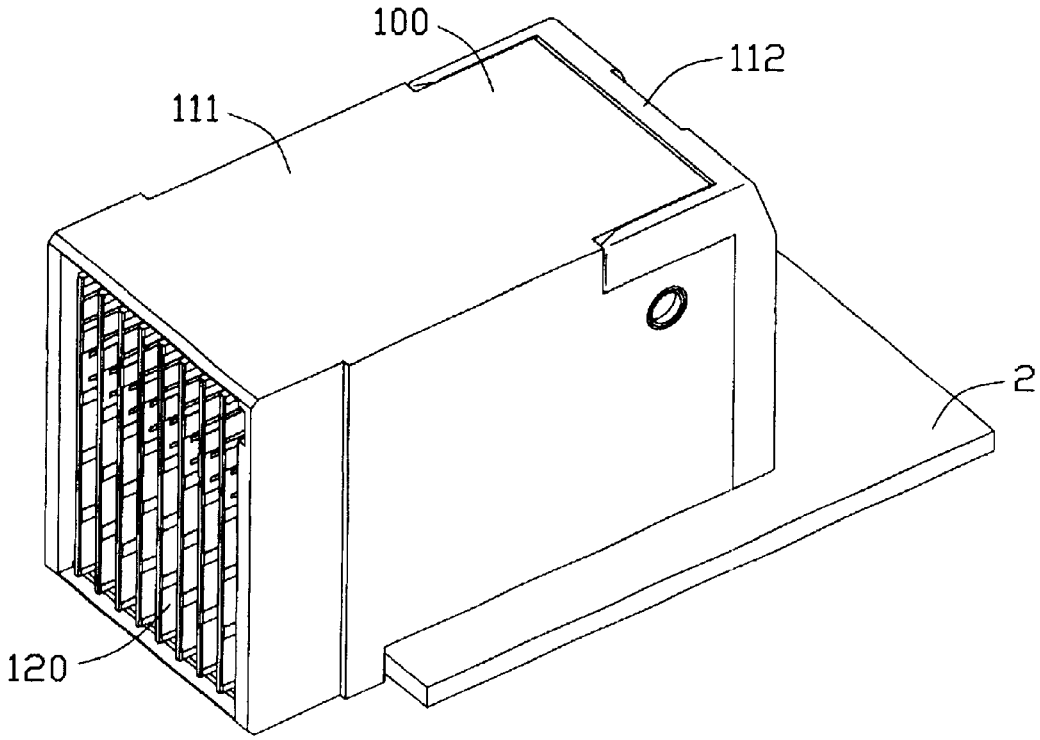
FIG. 4 is an assembled perspective view of FIG. 1.

Referring to FIGS. 1 to 4, an electrical connector 100 in accordance with a first embodiment of the present invention is adapted for mounting to a printed circuit board 2 and comprises an insulative housing 110, a plurality of inner printed circuit boards 120, and a plurality of wafers 130. The printed circuit board 2 comprises a plurality of contacting pads 20 on a surface thereof to which the electrical connector 100 is mounted and a plurality of through holes 21 extending therethrough.

The insulative housing 110 comprises a main portion 111 and a fastening portion 112. The main portion 111 defines a mating cavity 113 recessed from a front surface thereof, a plurality of slots 114 extending therethrough and opening to the mating cavity 113, and a mounting cavity 115 recessed in a rear and bottom portion thereof and communicating with the slots 114. The main portion 111 further defines a pair of opposite locking channels 116 at a rear top end thereof and a pair of cutouts 117 respectively opening to the locking channels 116. The fastening portion 112 comprises a cover section 118 and a pair of latches 119 extending forwardly from two opposite top sides of the cover section 118. The cover section 118 defines a pair of opposite channels 1181 extending vertically through two opposite sides thereof and a block 1182 protruding forwardly from an inner surface adjacent to a lower end thereof. Each latch 119 is formed with a hook section 1191 at a forward end thereof.

Figure 5:
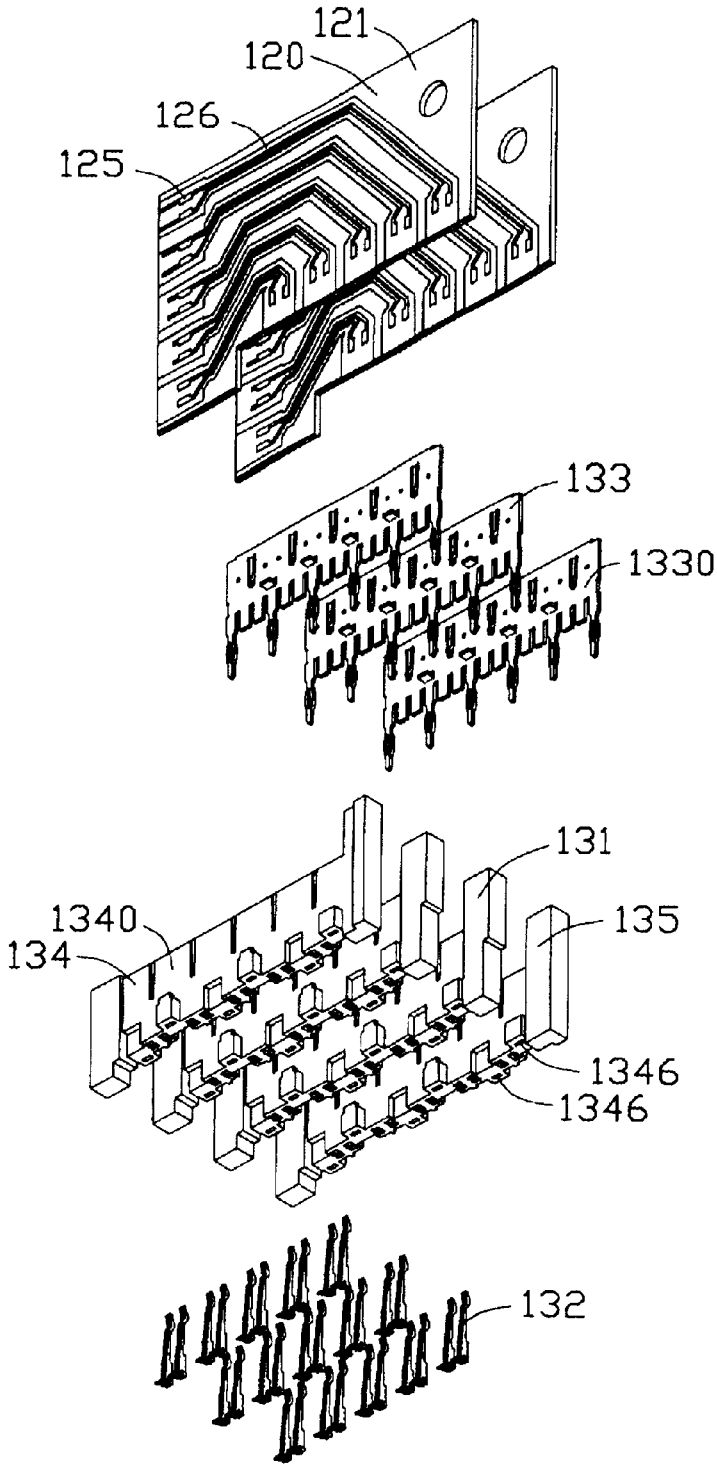
FIG. 5 is an exploded perspective view of wafers and inner printed circuit boards of the electrical connector of FIG. 1.
Figure 6:
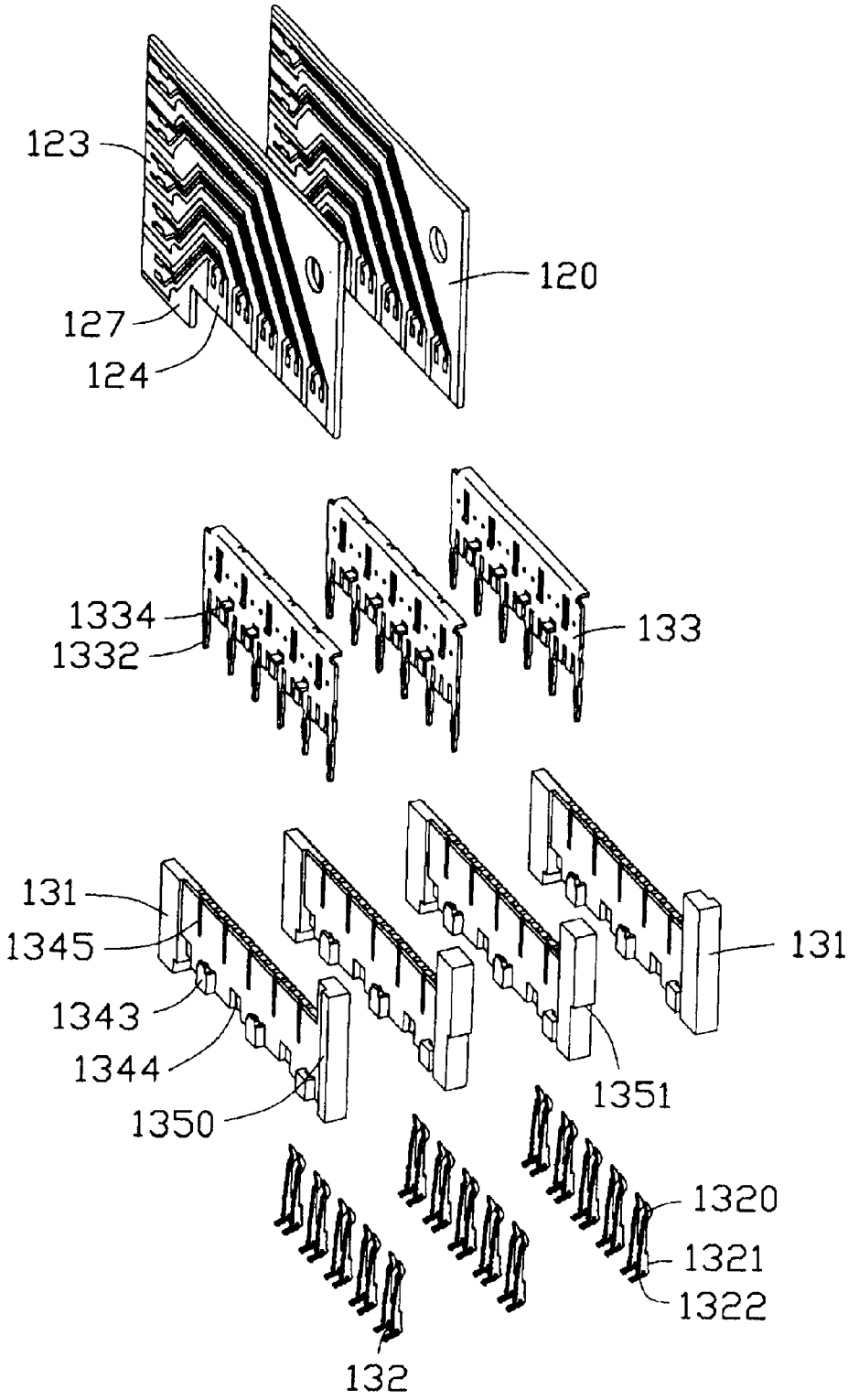
FIG. 6 is a view similar to FIG. 5, but taken from another perspective.
Figure 7:
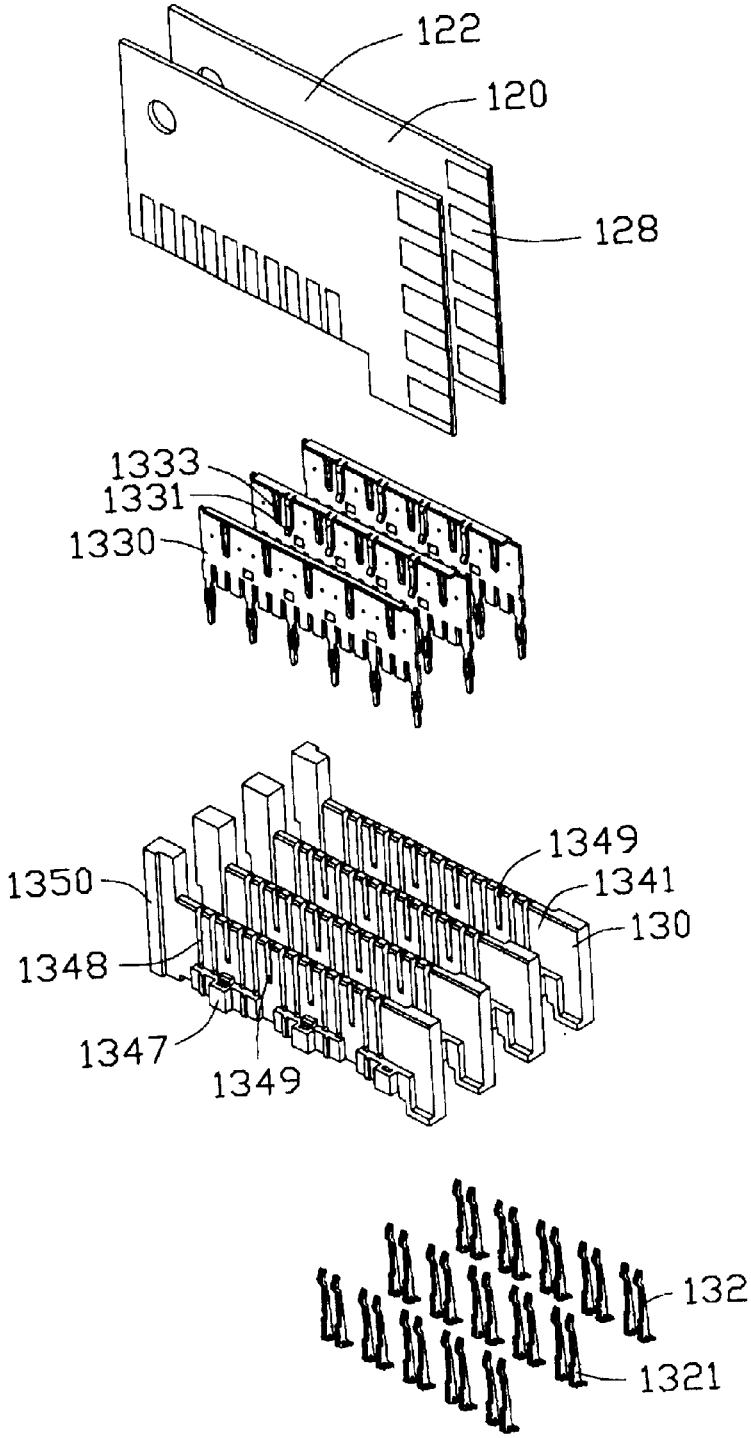
FIG. 7 is a view similar to FIG. 5, but taken from yet another perspective.

Referring also to FIGS. 5–7, each inner printed circuit board 120 comprises a first side 121, a second side 122 opposite to the first side 121, a mating portion 123 and a mounting portion 124. The first side 121 is formed with a plurality of signal pads (or gold fingers) 125 on the mating and the mounting portions 123, 124 thereof, a plurality of conductive traces 126 respectively electrically connect the signal pads 125 on the mating and the mounting portions 123, 124, and a plurality of grounding planes 127 surrounding the signal pads 125 and the conductive traces 126. The second side 122 is adapted to provide a grounding referential and is formed with a plurality of grounding pads (gold fingers) 128 at the mating and the mounting portions 123, 124 thereof.

Each of the wafers 130 comprises an insulative wafer body 131, a plurality of electrical contacts 132 and a grounding bus 133. The wafer body 131 comprises a retaining portion 134 and a shoulder 135 extending at one end of the retaining portion 134 with a top thereof protruding upwardly beyond a top of the retaining portion 134. The retaining portion 134 comprises a first side 1340, a second side 1341 opposite to the first side 1340, a plurality of first barbs 1343 extending outwardly adjacent to a lower section of the first side 1340, a plurality of recesses 1344 recessed from the first side 1340 and alternately arranged with respect to the first barbs 1343, a plurality of first channels 1345 extending downwardly from a top of the first side 1340 and located between every two adjacent first barb 1343 and recess 1344, a plurality of second barbs 1347 protruding outwardly from a lower portion of the second side 1341, a plurality of passageways 1348 extending vertically from the top through the bottom of the second side 1341, and a plurality of second channels 1349 extending downwardly between every two adjacent pairs of passageways 1348. Each of the first and the second barbs 1343, 1347 defines a hole 1346 extending vertically therethrough. The shoulders 135 of two of the wafer bodies 131 are formed with ribs 1350 protruding outwardly from one side surface thereof and the shoulders 135 of the other wafer bodies 131 have steps 1351 adjacent to a medial portion of an outward side thereof.

A pair of electrical contacts 132 are adapted to be mounted to one passageway 1348 of the wafer body 131 and each of the electrical contacts 132 comprises a fixing portion 1321 for retaining with the wafer body 131, an engaging portion 1320 extending upwardly from the fixing portion 1321 for electrically engaging with the signal pads 125 of the mounting portions 124 of the inner printed circuit boards 120 and a contact portion 1322 extending from the fixing portion 1321 beyond the bottom of the wafer body 131 for electrically engaging with the contacting pads 20 of the printed circuit board 2. The contact portion 1322 of each signal contact 132 defines an angle with respect to the fixing and the engaging portions 1321, 1320.

The grounding bus 133 comprises a generally flat plate portion 1330 for being attached to the first side 1340 of the wafer body 131, a plurality of fingers 1331 extending downwardly from a top of the plate portion 1330 and spaced from the plate portion 1330 for extending along the second channels 1349 of the second side 1341 of the wafer body 131 to electrically contact the grounding planes 127 of the mounting portions 124 of the inner printed circuit boards 120, and a plurality of spaced tails 1332 extending downwardly from a bottom of the plate portion 1330. The plate portion 1330 is formed with a plurality of tabs 1333 for extending downwardly and slightly outwardly along the first channels 1345 of the first side 1340 of the wafer body 131 to electrically contact the grounding pads 128 of the mounting portions 124 of the inner printed circuit boards 120 and a plurality of flanges 1334 bent substantially perpendicular thereto below the tabs 1333.

The wafers 130 are assembled together in such a way that the second barbs 1347 of the second side 1341 of one wafer body 131 engage with the recesses 1344 of the first side 1340 of another adjacent wafer body 131 and the tails 1332 of each grounding bus 133 extend through the holes 1346 of the first and the second blocks 1343, 1348 of the two adjacent wafer bodies 131, respectively, to be inserted into the through holes 21 of the printed circuit board 2 when the electrical connector 100 is mounted to the printed circuit board 2. The two wafer bodies 131 with the ribs 1350 on the shoulders 135 thereof are arranged as two outmost ones of the subassembly of the wafers 130.

Figure 8:
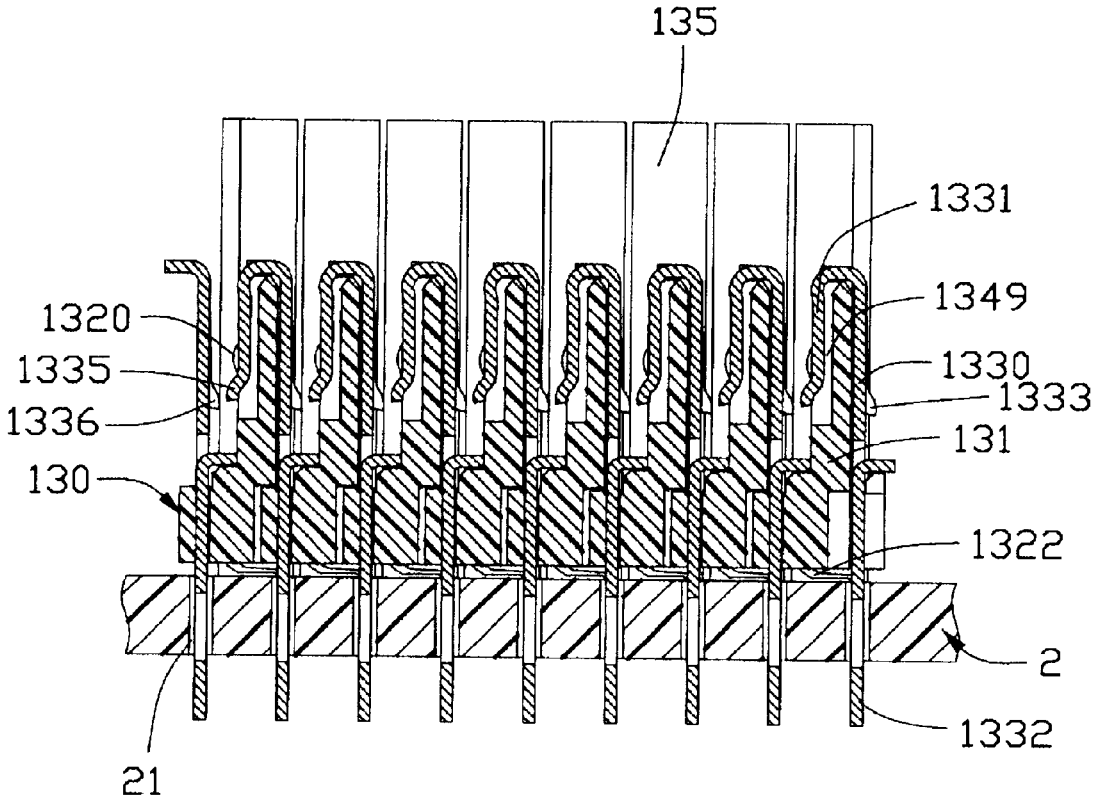
FIG. 8 is a cross-sectional view of assembled wafers of the electrical receptacle connector of FIG. 1 when mounting to the printed circuit board.
Figure 9:
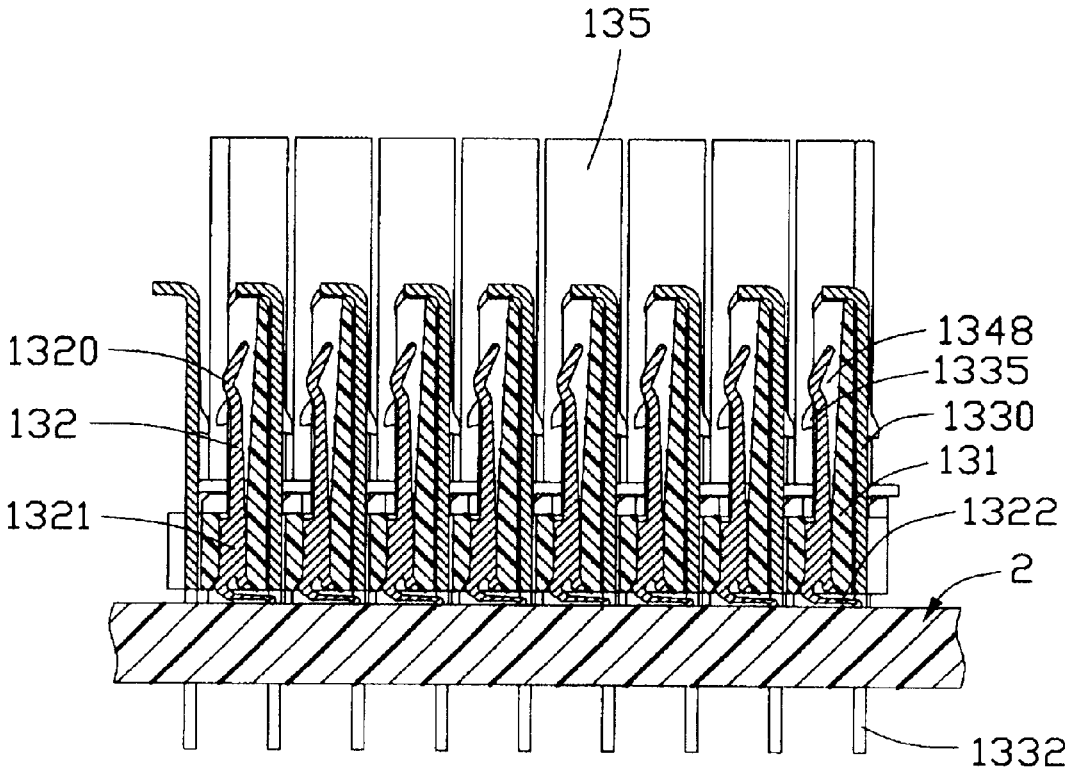
FIG. 9 is a view similar to FIG. 8.

Referring also to FIGS. 8 and 9, the fingers 1331, the tabs 1333 and the engaging portions 1320 of the electrical contacts 132 are stagger with respect to each other, that is, distances from the bottoms of the wafers 130 to contacting portions 1335 of the fingers 1331 are larger than distances from the bottoms of the wafers 130 to contacting portions 1336 of the tabs 1333 and smaller than distances from the bottoms of the wafers 130 to the engaging portions 1320 of the electrical contacts 132, and a line extending through the fingers 1331 of all of the wafers 130 will not extend through any of the electrical contacts 132 or the tabs 1333.

The mounting portions 124 of the inner printed circuit boards 120, as we know, are inserted into receiving spaces between the wafers 130 during the course of assembling the inner printed circuit boards 120 to the subassembly of the wafers 130 until being stopped and supported by the flanges 1334 of the grounding buses 130. Since the fingers 1331, the tabs 1333 and the engaging portions 1320 of the electrical contacts 132 are stagger, so the insertion force of the inner printed circuit boards 120 is divided along the inner printed circuit boards 120 and is significantly reduced, thereby simplifying the assembly procedure.

The subassembly of the inner printed circuit boards 120 and the wafers 130 is then assembled to the main portion 111 of the insulative housing 110 in such a way that the inner printed circuit boards 120 are substantially accommodated in the slots 114 with the mating portions 123 of the inner printed circuit boards 120 extending into the mating cavity 113 of the main portion 111 of the insulative housing 110. The wafers 130 are accommodated in the mounting cavity 115 of the main portion 111 of the insulative housing 110. The hook sections 1191 of the latches 119 of the fastening portion 112 extend into the cutouts 117 and the channels 1181 of the cover section 118 of the fastening portion 112 engage with the ribs 1350 of the wafers 130 while the block 1182 of the cover section 118 of the fastening portion 112 engages with the steps 1351 of wafers 130. In such a way, the electrical connector 100 is assembled.

Figure 10:
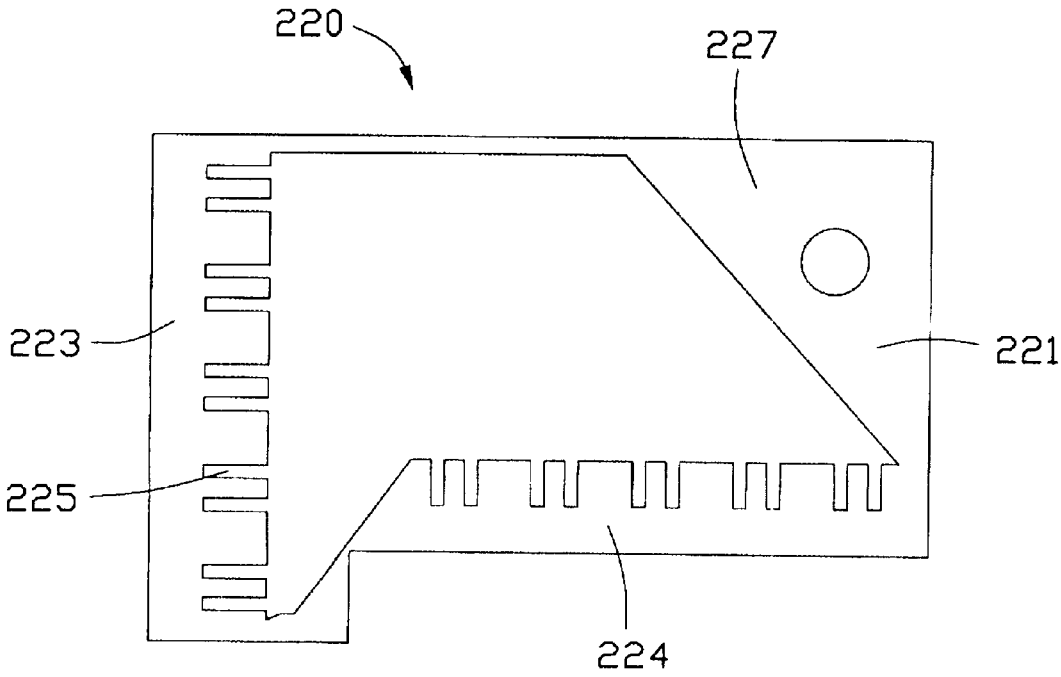
FIG. 10 is a front planar view of an inner printed circuit board in accordance with a second embodiment of the present invention.
Figure 11:
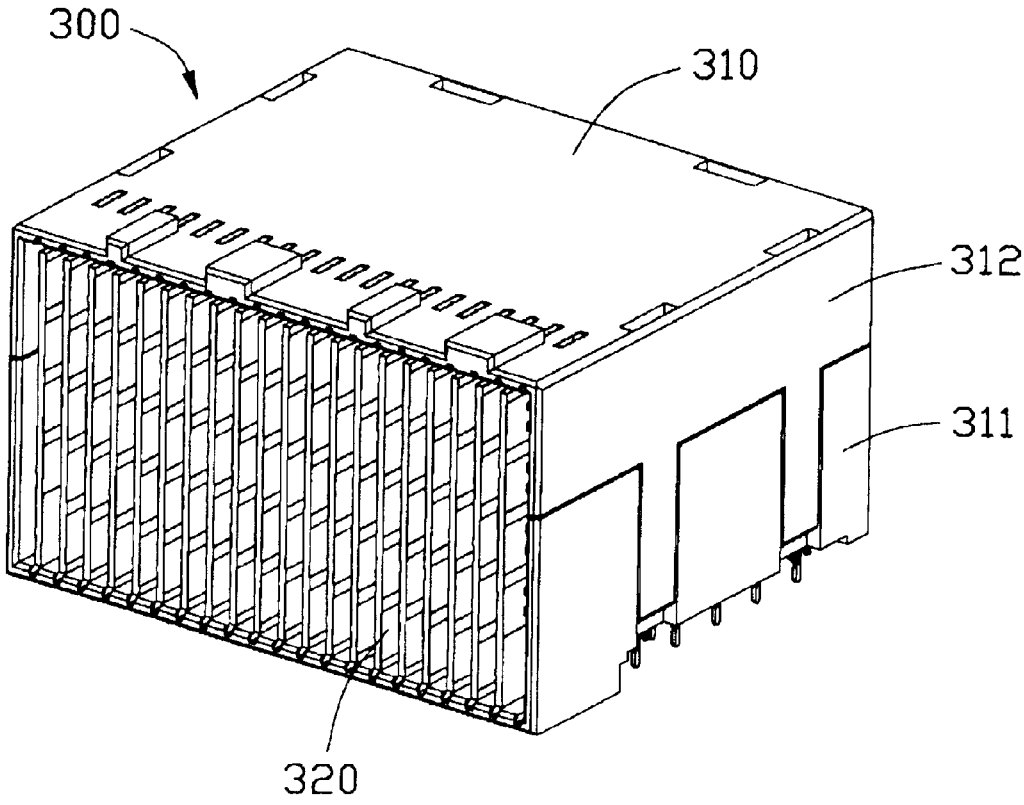
FIG. 11 is a perspective view of an electrical connector in accordance with a third embodiment of the present invention.
Figure 12:
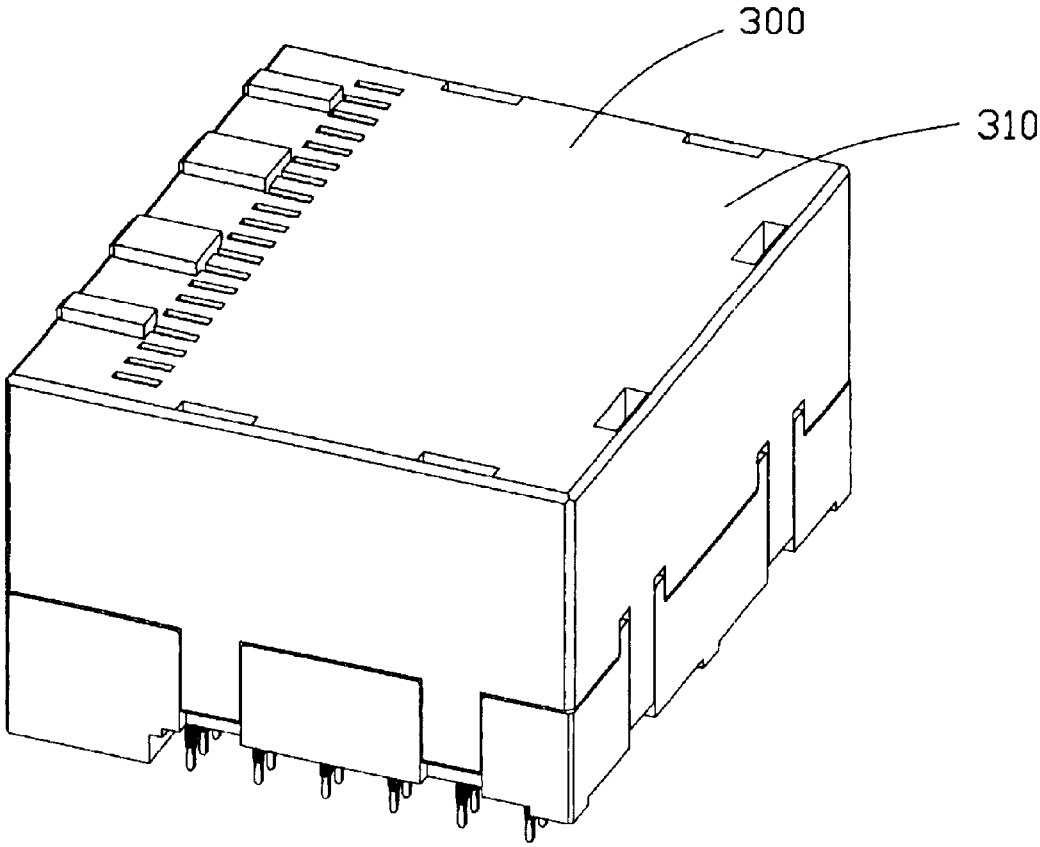
FIG. 12 is a view similar to FIG. 11, but taken from another perspective.
Figure 13:
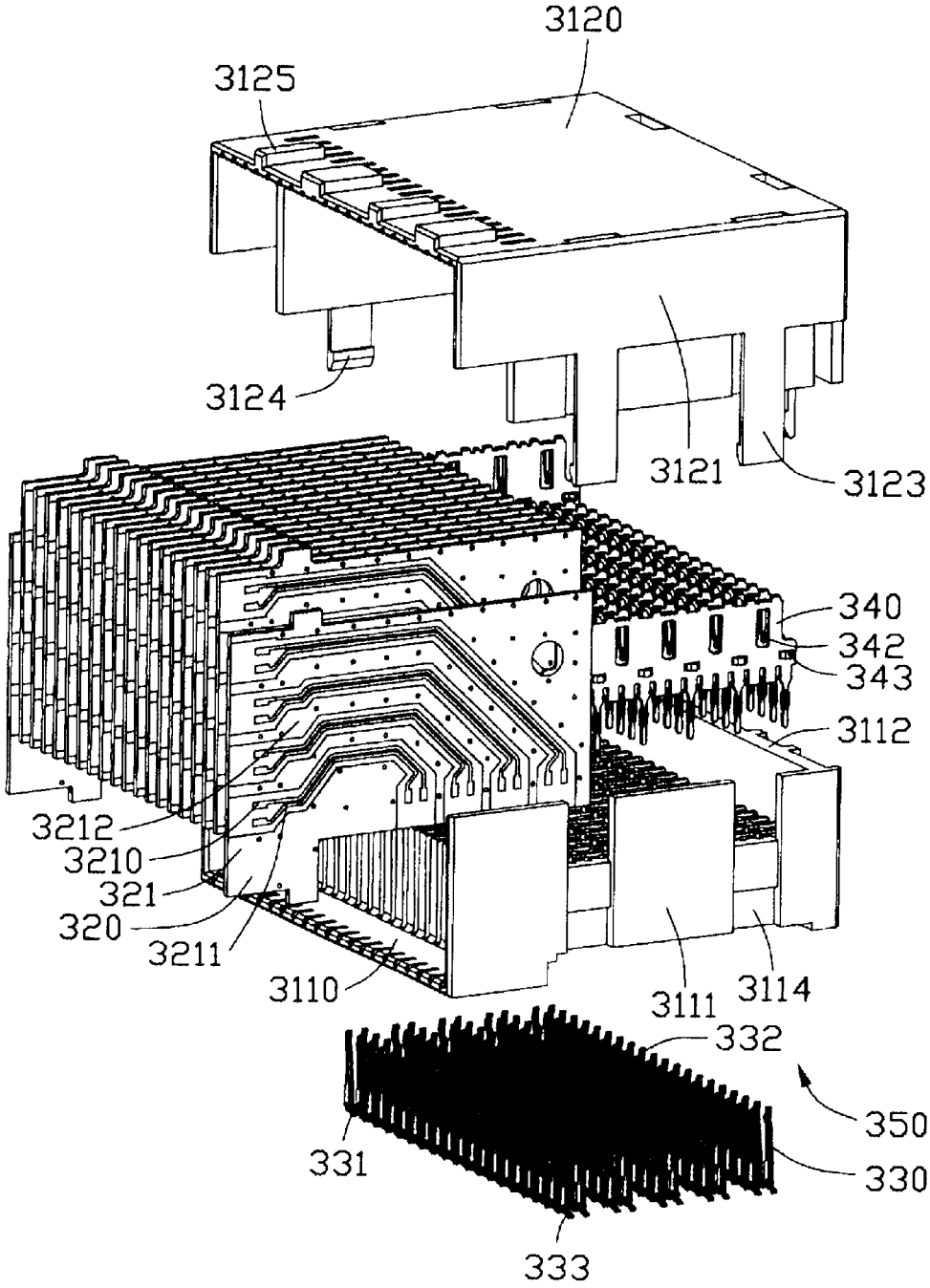
FIG. 13 is an exploded perspective view of the electrical connector of FIG. 11.
Figure 14:
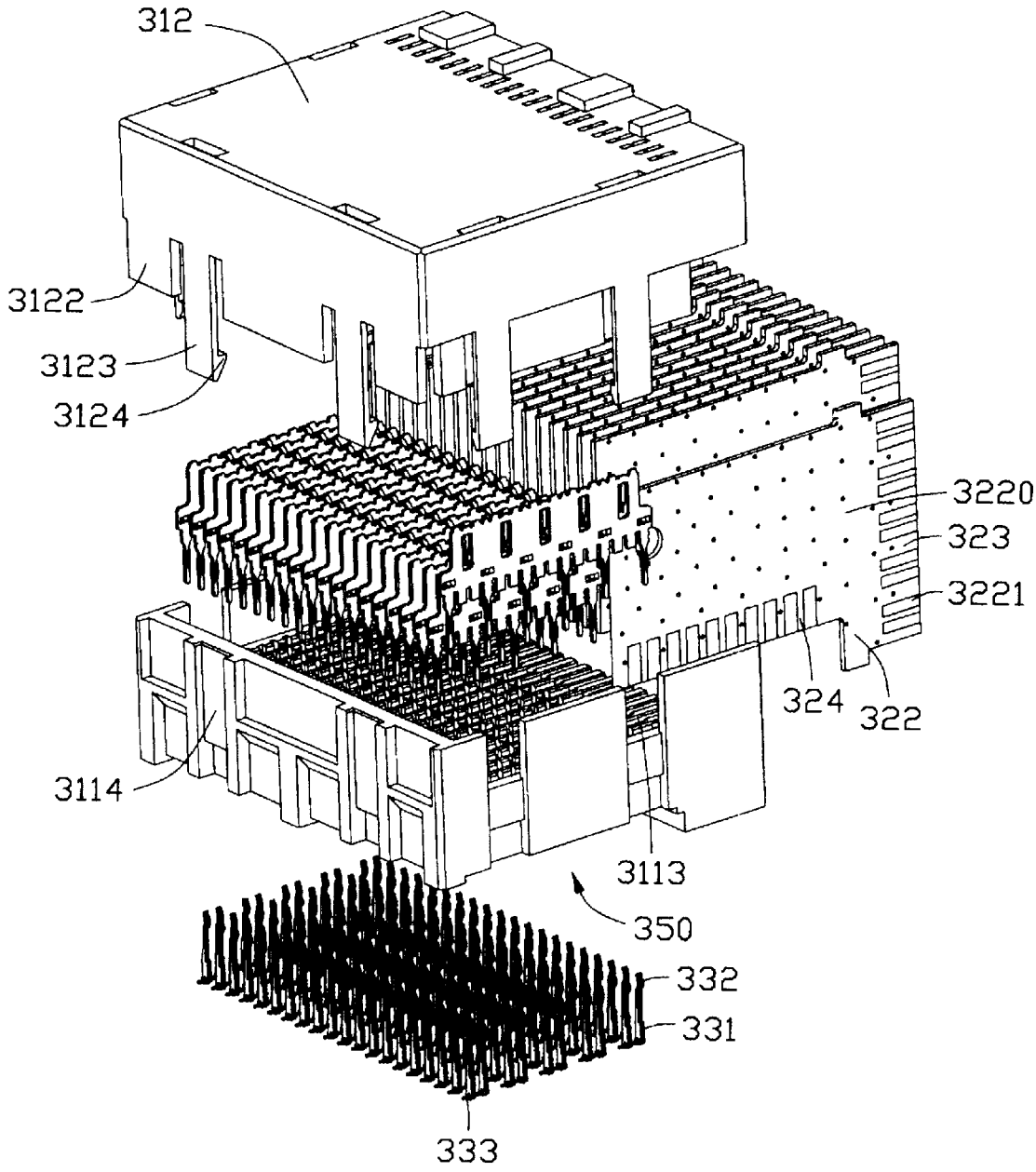
FIG. 14 is a view similar to FIG. 13 but taken from a different perspective.

Referring to FIG. 10, an inner printed circuit board 220 in accordance with a second embodiment of the present invention and for use with the electrical connector 100 is shown. The inner printed circuit board 220 is substantially similar to the inner printed circuit board 120 of the first embodiment, except that a first side 221 thereof is formed with a plurality of power pads 225 on a mating and a mounting portions 223, 224, respectively besides a plurality of grounding planes 227 surrounding the power pads 225. The inner printed circuit board 220 can be used to transmit power. The inner printed circuit board 220 can also be adapted to other configurations to match different requirements of applications.

Referring to FIGS. 11 to 14, an electrical connector 300 in accordance with a third embodiment of the present invention comprises an insulative housing 310, a plurality of inner printed circuit boards 320, and a plurality of wafers 350.

The insulative housing 310 comprises a main portion 311 and a fastening portion 312. The main portion 311 comprises a bottom wall 3110, a pair of opposite side walls 3111 extending from two opposite sides of the bottom wall 3110 and a rear wall 3112 extending from the bottom wall 3110 and connecting the side walls 3111. Each of the side and the rear walls 3111, 3112 comprises a pair of locking channels 3114 extending vertically therealong.

The fastening portion 312 comprises a cover section 3120, a pair of side walls 3121 extending from two opposite sides of the cover section 3120 and a rear wall 3122 extending from the cover section 3120 and connecting the side walls 3121. The cover section 3120 is formed with a plurality of bumps 3125 adjacent to a front end thereof. Each of the side and the rear walls 3121, 3122 comprises a pair of latches 3123 extending along the locking channels 3114 of the main portion 311 and each comprising a hook section 3124 for engaging with the bottom of the main portion 311 to latch the main portion 311 and the fastening portion 312 together.

Each of the inner printed circuit boards 320 comprises a first side 321, a second side 322 opposite to the first side 321, a mating portion 323, and a mounting portion 324. The first side 321 comprises a plurality of signal pads (gold fingers) 3210 on the mating and the mounting portions 323, 324, a plurality of conductive traces 3211 extending between and electrically connecting the signal pads 3210 of the mating and the mounting portions 323, 324, and a plurality of grounding planes 3212 surrounding the signal pads 3210 and the conductive traces 3211. The second side 322 of the inner printed circuit board 320 is adapted to provide a grounding referential and comprises a plurality of grounding pads (gold fingers) 3221 on the mating and the mounting portions 323, 324.

Each wafer 350 comprises an insulative wafer body 3113 extending from the bottom wall 3110 and between the side and the rear walls 3110, 3112 of the main portion 311 of the insulative housing 310, a plurality of electrical contacts 330 mounted to the wafer body 3113 and a grounding bus 340 mounted to the wafer body 3113. The wafer bodies 3113 are formed somewhat like the wafer bodies 131 of the electrical connector 100 of the first embodiment except that the wafer bodies 3113 are integral with insulative housing 310 and have no assembling structures therebetween and between the insulative housing 310, so a detailed description thereabout is omitted herefrom.

The electrical contacts 330 and the grounding buses 340 are substantially similar to the electrical contacts 132 and the grounding buses 133 of the first embodiment and are mounted to the wafer bodies 3113 in substantially the same way as the electrical contacts 132 and the grounding buses 133 of the first embodiment. Each electrical contact 330 comprises a fixing portion 331 for retaining to the wafer body 3113, an engaging portion 332 extending from the fixing portion 331 for electrically engaging with the signal pads 3210 of the inner printed circuit board 320 and a contact portion 333 extending from the fixing portion 331 beyond the wafer body 3113 for electrically contacting with contacting pads (not shown) on a printed circuit board (not shown) to which the electrical connector 300 is mounted. Each grounding bus 340 comprises a plurality of fingers 341 for electrically contacting the grounding planes 3212 of the mounting portion 324 of the inner printed circuit board 320, a plurality of tabs 342 for electrically mating with the grounding pads 3221 of the mounting portion 324 of the inner printed circuit board 320 and a plurality of flanges 343 curved beyond one side surface of the grounding bus 340 for stopping and supporting the mounting portion 324 of the inner printed circuit board 320.

Figure 15:
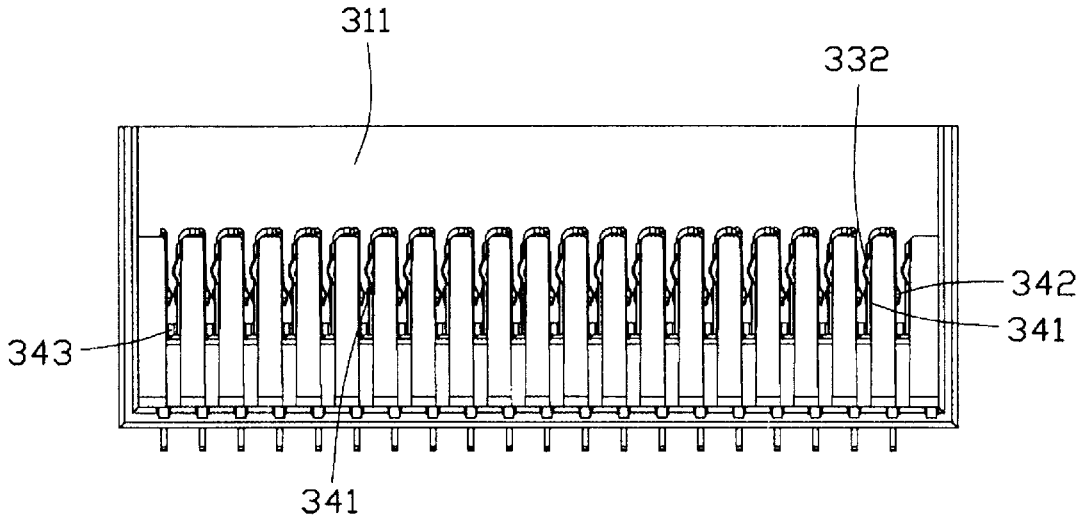
FIG. 15 is a cross-sectional view of the electrical connector of FIG. 11 with a fastening portion of an insulative housing and inner printed circuit boards thereof being removed therefrom.

Referring also to FIG. 15, the fingers 341, the tabs 342 of the grounding buses 340 and the engaging portions 332 of the electrical contacts 330 are also stagger with respect to each other, so an insertion force needed to insert the mounting portions 324 of the inner printed circuit boards 320 into receiving spaces between the wafer 350 for the purpose of assembling the inner printed circuit boards 320 with the wafers 350 is reduced, thereby simplifying the assembly procedure of the electrical connector 300.

Figure 16:
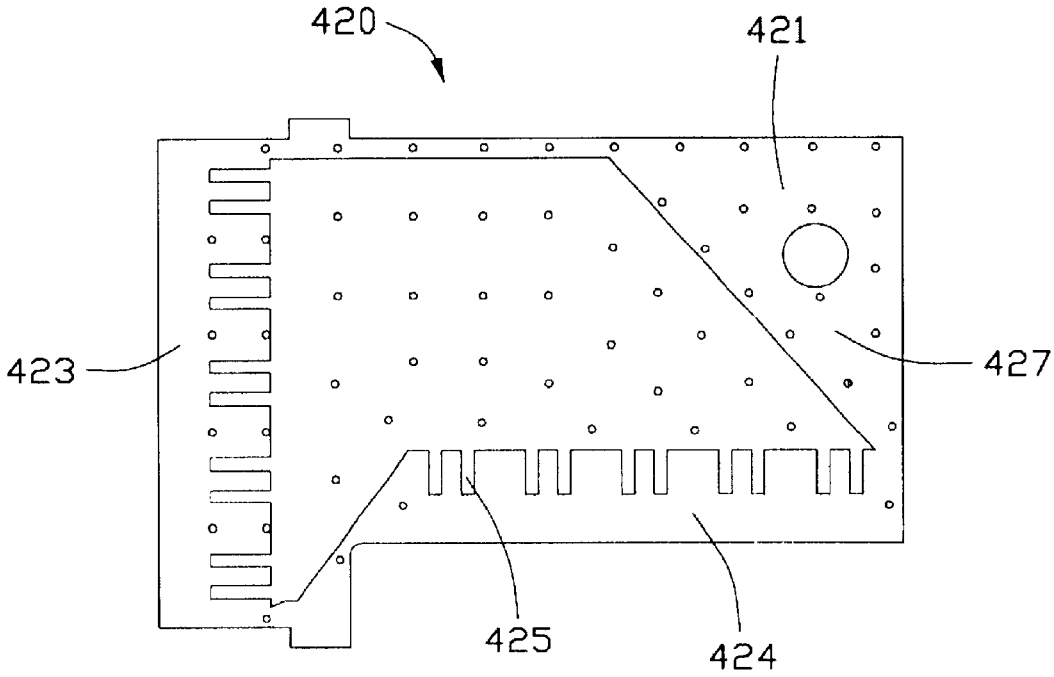
FIG. 16 is a front planar view of an inner printed circuit board in accordance with a fourth embodiment of the present invention.

Referring also to FIG. 16, an inner printed circuit board 420 in accordance with a fourth embodiment of the present invention and for use with the electrical connector 300 is substantially similar to the inner printed circuit board 320 except that a first side 421 thereof is formed with a plurality of power pads 425 on a mating and a mounting portions 423, 424 besides grounding planes 427 surrounding the power pads 425. This inner printed circuit board 420 is used to transmit power and, of course, the inner printed circuit board 420 can be further adapted to match any other application environments.

Although the above-mentioned wafer bodies, electrical contacts and grounding buses are similar, they can be different, if desired, within the principles of the present invention.

In use, when the inner printed circuit boards 120, 320 are used for the electrical connectors 100, 300 respectively, the electrical connectors 100, 300 can be used for signal transmission. When the electrical connectors 100, 300 are to be used in the application environments of power transmissions, the inner printed circuit boards 120, 320 can be respectively replaced by the inner printed circuit boards 220, 420. In such a way, the change of application environments of the electrical connectors 100, 300 does not result in that the whole electrical connectors 100, 300 need to be replaced, thereby reducing the cost. It is easy to know that the electrical connector 100, 300 can also be adapted to transmit two different types of data, such as signal and power, by way of incorporating both the inner printed circuit boards 120 and 220, 320 and 420, respectively, therein.

Since the inner printed circuit boards 120, 220, 320, 420 can be easily replaced, the electrical connector 100, 300 is easily customizable according to application environments with reduced cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

a plurality of wafers being accommodated in the insulative housing, each wafer comprising an insulative wafer body, a plurality of electrical contacts mounted to the wafer body and a grounding bus mounted to the wafer body; and a plurality of inner printed circuit boards being substantially enclosed in the insulative housing, each inner printed circuit board being detachably received between two adjacent ones of the wafers to electrically contact with the electrical contacts and the grounding buses.

2. The electrical connector as claimed in claim 1, wherein the insulative housing comprises a main portion and a fastening portion retained to the main portion, and wherein the main portion and the fastening portion secure the inner printed circuit boards therebetween.

3. The electrical connector as claimed in claim 1, wherein the insulative wafer body is integral with the insulative housing.

4. The electrical connector as claimed in claim 1, wherein the insulative wafer body is assembled to the insulative housing.

5. The electrical connector as claimed in claim 1, wherein one of the inner printed circuit boards defines a first side comprising a plurality of signal pads and a plurality of grounding planes surrounding the signal pads and, wherein the electrical contacts of one of the two adjacent ones of the wafers electrically contact with the signal pads of the first side of the inner printed circuit board.

6. The electrical connector as claimed in claim 5, wherein the one of the inner printed circuit boards defines a second side comprising a plurality of grounding pads and wherein the grounding buses of the two adjacent ones of the wafers electrically contact with the grounding planes and the grounding pads of the first and the second sides of the one of the inner printed circuit boards, respectively.

7. The electrical connector as claimed in claim 1, wherein one of the inner printed circuit boards defines a first side comprising a plurality of power pads and a plurality of grounding planes surrounding the power pads and, wherein the electrical contacts of one of the two adjacent ones of the wafers electrically contact with the power pads of the inner printed circuit board.

8. The electrical connector as claimed in claim 7, wherein the one of the inner printed circuit boards defines a second side comprising a plurality of grounding pads and wherein the grounding buses of the two adjacent ones of the wafers electrically contact with the grounding planes and the grounding pads of the first and the second sides of the one of the inner printed circuit boards, respectively.

9. An electrical connector comprising:

an insulative housing;

a plurality of wafers being accommodated in the insulative housing, each wafer comprising an insulative wafer body, a plurality of electrical contacts mounted to the wafer body, and a grounding bus mounted to the wafer body; and a plurality of inner printed circuit boards each comprising a mounting portion to be inserted between two adjacent wafers, the mounting portion of each inner printed circuit board electrically contacting with the electrical contacts of one of the wafers and the grounding buses of two adjacent ones of the wafers.

10. The electrical connector as claimed in claim 9, wherein the inner printed circuit boards are detachable with respect to the insulative housing and the wafers.

11. The electrical connector as claimed in claim 9, wherein each of the inner printed circuit boards comprises a mating portion, and wherein the mating and the mounting portions of each inner printed circuit board are electrically connected with each other.

12. The electrical connector as claimed in claim 11, wherein each of the inner printed circuit boards comprises a first side and a second side opposite to the first side, the first side comprising a plurality of power pads on the mating and the mounting portions thereof and a plurality of conductive traces electrically connecting the power pads on the mating and the mounting portions.

13. The electrical connector as claimed in claim 12, wherein the electrical contacts of the wafers electrically contact with the power pads of the mounting portions of the first side of inner printed circuit boards.

14. The electrical connector as claimed in claim 11, wherein each of the inner printed circuit boards comprises a first side and a second side opposite to the first side, the first side comprising a plurality of signal pads on the mating and the mounting portions thereof and a plurality of conductive traces electrically connecting the signal pads on the mating and the mounting portions.

15. The electrical connector as claimed in claim 14, wherein the electrical contacts of the wafers electrically contact with the signal pads of the mounting portions of the first side of the inner printed circuit boards.

16. The electrical connector as claimed in claim 14, wherein the second side comprises a plurality of grounding pads on the mating and the mounting portions, and the grounding pads of the mating portions electrically connect with the grounding pads of the mounting portions.

17. An electrical connector comprising:

an insulative housing;

first and second wafers arranged in the housing defining a receiving space therebetween, the first wafer comprising a signal contact extending into the receiving space, the second wafer comprising a grounding bus comprising a tab extending into the receiving space; and an inner printed circuit board being detachably received between the first and the second wafers to electrically contact the signal contact and the tab of the grounding bus of the first and the second wafers, respectively.

18. The electrical connector as claimed in claim 17, wherein said inner printed circuit boards are categorized with two different types, of which one is for signal transmission and the other is for power transmission.

* * * * *